US012063956B2

(12) United States Patent
Pijnenburg et al.

(10) Patent No.: US 12,063,956 B2
(45) Date of Patent: Aug. 20, 2024

(54) METHOD FOR MANUFACTURING AN INDUCTIVELY HEATABLE AEROSOL-FORMING SUBSTRATE

(71) Applicant: PHILIP MORRIS PRODUCTS S.A., Neuchatel (CH)

(72) Inventors: Johannes Petrus Maria Pijnenburg, Neuchatel (CH); Oleg Mironov, Neuchatel (CH); Yorick Klipfel, St. Saphorin-sur-Morges (CH)

(73) Assignee: Philip Morris Products S.A., Neuchatel (CH)

( * ) Notice: Subject to any disclaimer, the term of this patent is extended or adjusted under 35 U.S.C. 154(b) by 9 days.

(21) Appl. No.: 17/873,294

(22) Filed: Jul. 26, 2022

(65) Prior Publication Data

US 2022/0354157 A1 Nov. 10, 2022

Related U.S. Application Data

(62) Division of application No. 15/741,843, filed as application No. PCT/EP2016/065745 on Jul. 5, 2016, now Pat. No. 11,425,926.

(30) Foreign Application Priority Data

Jul. 6, 2015 (EP) ..... 15175438

(51) Int. Cl.
*A24D 1/20* (2020.01)
*A24C 5/01* (2020.01)

(52) U.S. Cl.
CPC . *A24D 1/20* (2020.01); *A24C 5/01* (2020.01)

(58) Field of Classification Search
None
See application file for complete search history.

(56) References Cited

U.S. PATENT DOCUMENTS

| | | | | |
|---|---|---|---|---|
| 3,540,456 | A | 11/1970 | McGlumphy | |
| 5,016,656 | A | 5/1991 | McMurtrie | |
| 5,369,723 | A | 11/1994 | Counts | |
| 5,396,911 | A | 3/1995 | Casey, III | |
| 5,613,505 | A * | 3/1997 | Campbell | H05B 6/365 131/194 |
| 8,689,804 | B2 | 4/2014 | Fernando | |
| 2014/0166032 | A1 * | 6/2014 | Gindrat | A24B 15/165 131/353 |

FOREIGN PATENT DOCUMENTS

| | | |
|---|---|---|
| CN | 1126426 | 7/1996 |
| EP | 0565360 | 10/1993 |

(Continued)

*Primary Examiner* — Phu H Nguyen
(74) *Attorney, Agent, or Firm* — Mueting Raasch Group

(57) ABSTRACT

The method for manufacturing an inductively heatable aerosol-forming substrate comprises the steps of providing a tobacco containing slurry, providing an inductively heatable continuous sheet-like material and joining the tobacco containing slurry and the inductively heatable continuous sheet-like material to form an inductively heatable aerosol-forming substrate. A further step comprises drying the inductively heatable aerosol-forming substrate while transporting the inductively heatable aerosol-forming substrate on a conveyor device.

14 Claims, 1 Drawing Sheet

(56) References Cited

FOREIGN PATENT DOCUMENTS

| | | |
|---|---|---|
| EP | 2327318 | 6/2011 |
| RU | 2097996 | 12/1997 |
| RU | 2517125 | 1/2013 |
| WO | WO 94/06313 | 3/1994 |
| WO | WO 95/27411 | 10/1995 |
| WO | WO 2012/164009 | 12/2012 |
| WO | WO 2013/098405 | 7/2013 |
| WO | WO 2015/071682 | 5/2015 |
| WO | WO 2015/082651 | 6/2015 |

* cited by examiner

METHOD FOR MANUFACTURING AN INDUCTIVELY HEATABLE AEROSOL-FORMING SUBSTRATE

This application is a divisional of U.S. application Ser. No. 15/741,843, filed Jan. 4, 2018 and which is a U.S. National Stage Application of International Application No. PCT/EP2016/065745, filed Jul. 5, 2016, which was published in English on Jan. 12, 2017, as International Publication No. WO 2017/005705 A1. International Application No. PCT/EP2016/065745 claims priority to European Application No. 15175438.9 filed Jul. 6, 2015.

The invention relates to the manufacture of an inductively heatable aerosol-forming substrate. In particular, the invention relates to the manufacture of such substrates for producing inductively heatable aerosol-forming articles to be used in inductively heatable electronic aerosol-generating devices.

From prior art tobacco containing aerosol-forming substrates, so-called 'cast leaf' are known. Cast leaf is manufactured from a tobacco containing slurry, which slurry is spread into a sheet and dried. The so formed cast leaf is formed into a rod shape, for example by crimping and gathering, thus forming a continuous rod of tobacco plugs. A method for forming a continuous rod from a cast leaf is described, for example, in the international patent publication WO-A-2012/164009. The individual tobacco plugs are formed by cutting the continuous rod. Such plugs may be used in consumables for electronic aerosol-generating devices. Such consumables may comprise a tobacco plug as well as further elements, for example as disclosed in the international patent publication WO-A-2013/098405. In WO-A-2013/098405, the consumables comprise a tobacco plug, as well as a support element, an aerosol-cooling element and a filter element.

Cast leaf has low tensile strength, which complicates handling and slows down a processing speed of a consumable manufacturing process.

Therefore, it would be desirable to improve the handling of aerosol-forming substrates.

According to an aspect of the present invention, there is provided a method for manufacturing an inductively heatable aerosol-forming substrate. The method comprises the steps of providing a tobacco containing slurry and providing an inductively heatable continuous sheet-like material. Further steps of the method comprise joining the tobacco containing slurry and the inductively heatable continuous sheet-like material to form an inductively heatable aerosol-forming substrate and drying the inductively heatable aerosol-forming substrate while transporting the inductively heatable aerosol-forming substrate on a conveyor device.

By combining a tobacco slurry with a continuous sheet-like material, stability may be provided to the aerosol-forming substrate. This may reduce down-time of a manufacturing line for aerosol-generating tobacco articles made of inductively heatable aerosol-forming substrate, for example of crimped and gathered inductively heatable aerosol-forming substrate. Thus, manufacturing performance of aerosol-generating products may be improved. Also a processing speed of the inductively heatable aerosol-forming substrate may be enhanced compared to a processing speed of the plain aerosol-forming substrate (not being provided with a sheet-like inductively heatable material).

In addition, some components of the tobacco containing slurry that are added in order to enhance handling properties of the aerosol-forming substrate may be reduced. Such components may, for example, be fibers and binders. With the method according to the invention, the aerosol-forming substrate is directly made inductively heatable, that is during production of the substrate.

Yet further, the close contact of inductively heatable continuous sheet-like material with the aerosol-forming substrate has many advantages. For example, it may lead to a very homogeneous temperature profile across a tobacco plug manufactured from the inductively heatable aerosol-forming substrate. Unused substrate, for example in peripheral or central regions of the tobacco plug may thus be avoided. Also an amount of substrate may be reduced due to an efficient use of the substrate. Waste of material or costs are thus reduced. Another advantage is that overheating of the aerosol-forming substrate may be prevented and thus combustion of the substrate and the amount of combustion products formed may be reduced. The amount of heating energy may be reduced, which may in particular be advantageous in view of battery capacity of an electronic heating device.

The manufacturing method according to the invention preferably comprises the step of supplying either one of the inductively heatable continuous sheet-like material or the tobacco containing slurry onto the conveyor device. An inductively heatable continuous sheet-like material may, for example, be unwound from a bobbin and laid onto the conveyor device. A tobacco containing slurry may, for example, be supplied from a slurry reservoir and cast onto the conveyor device, preferably in a metered amount forming a sheet. A further step then comprises depositing the tobacco containing slurry onto the inductively heatable continuous sheet-like material, which is transported on the conveyor device. Alternatively, the further step may comprise depositing the inductively heatable continuous sheet-like material onto the tobacco containing slurry, if it was the tobacco containing slurry that has been supplied to the conveyor device first. Preferably, a supply of either the inductively heatable continuous sheet-like material or the tobacco containing slurry to the conveyor device is performed at an upstream end of the conveyor device, that is, at an upstream end of a transport section on the conveyor device. By this, an entire length of a conveyor device may be used for transporting or processing the inductively heatable aerosol-forming substrate.

In a variant of the manufacturing method, the step of joining the tobacco containing slurry and the inductively heatable continuous sheet-like material comprises supplying the tobacco containing slurry onto the inductively heatable continuous sheet-like material before the so formed inductively heatable aerosol-forming substrate is arranged and transported on the conveyor device. In this variant, the inductively heatable continuous sheet-like material preferably is a non-porous or closed sheet, such as for example a foil. By this, the slurry may not fall through the sheet-like material via pores, openings or interstices in the continuous sheet-like material.

A coater may be provided for supplying the tobacco containing slurry onto the conveyor device or the inductively heatable continuous sheet-like material. Such a coater may be a conventionally available coater, such as, for example, gate coater or reverse roller coater. In gate coaters, a slit width of the coater may define the amount of slurry leaving the coater. In reverse roller coaters, an amount of slurry to be applied is mainly defined by the distance of an application roller and a metering roller (at a defined viscosity of the slurry). A sheet thickness formed by the supplied slurry may also be defined or varied by the speed of the inductively heatable continuous sheet-like material or by the conveyor device passing the coater, while the slurry is applied to the conveyor device or to the inductively heatable material.

The conveyor device may be a conveyor belt, for example a closed-loop conveyor belt. An inductively heatable material or a tobacco containing slurry is then supplied to an upper surface of the conveyor belt, for example, laid onto or applied to the conveyor belt. A conveyor belt or the conveyor device is adapted to this purpose accordingly.

Preferably, a speed of the conveyor device is synchronized with a moving speed of the inductively heatable material and a flow rate of slurry (predefined amount of slurry per time). If slurry and inductively heatable material are joined before being arranged on the conveyor device, joining speed and speed of the conveyor device may be substantially independent of each other. This may be advantageous, if, for example, a residence time of the inductively heatable aerosol-forming substrate on the conveyor belt shall be reduced or extended. This may, for example, be the case in changing environmental conditions, in interruption of machine parts or processes before or after the conveyor device. A buffer device may be provided between coater and conveyor belt for buffering inductively heatable aerosol-forming substrate to be supplied to the conveyor belt.

The inductively heatable aerosol-forming substrate may be dried, while being transported on the conveyor device. Preferably drying is done via heating, for example, by heat transfer from the conveyor device, by hot air or an infrared source. The conveyor device may be a heatable conveyor belt.

The so formed inductively heatable aerosol-forming substrate may be wound onto a bobbin for further use. The edges of the substrate may be trimmed and the substrate may be slitted. However, slitting may also be performed after the substrate sheet has been wound onto a bobbin. The bobbin may then be transferred to a sheet processing installation, such as for example a crimping and rod forming unit or may be put to a bobbin storage for future use.

The tobacco containing slurry and the tobacco sheet forming the aerosol-forming substrate made from the tobacco containing slurry comprises tobacco particles, fiber particles, aerosol former, binder and for example also flavours. Preferably, the tobacco sheet is a cast leaf. Cast leaf is a form of reconstituted tobacco that is formed from the tobacco containing slurry.

Tobacco particles may be of the form of a tobacco dust having particles in the order of 30 micrometers to 250 micrometers, preferably in the order of 30 micrometers to 80 micrometers or 100 micrometers to 250 micrometers, depending on the desired sheet thickness and casting gap, where the casting gap typically defines the thickness of the sheet.

Fiber particles may include tobacco stem materials, stalks or other tobacco plant material, and other cellulose-based fibers such as wood fibers having a low lignin content. Fiber particles may be selected based on the desire to produce a sufficient tensile strength for the cast leaf versus a low inclusion rate, for example, an inclusion rate between approximately 2 percent to 15 percent. Alternatively, fibers, such as vegetable fibers, may be used either with the above fiber particles or in the alternative, including hemp and bamboo.

Aerosol formers included in the slurry forming the cast leaf may be chosen based on one or more characteristics. Functionally, the aerosol former provides a mechanism that allows it to be volatilized and convey nicotine or flavouring or both in an aerosol when heated above the specific volatilization temperature of the aerosol former. Different aerosol formers typically vaporize at different temperatures. An aerosol former may be chosen based on its ability, for example, to remain stable at or around room temperature but able to volatize at a higher temperature, for example, between 40 degree Celsius and 450 degree Celsius. The aerosol former may also have humectant type properties that help maintain a desirable level of moisture in an aerosol-forming substrate when the substrate is composed of a tobacco-based product including tobacco particles. In particular, some aerosol formers are hygroscopic material that function as a humectant, that is, a material that helps keep a substrate containing the humectant moist.

One or more aerosol former may be combined to take advantage of one or more properties of the combined aerosol formers. For example, triacetin may be combined with glycerin and water to take advantage of the triacetin's ability to convey active components and the humectant properties of the Glycerin.

Aerosol formers may be selected from the polyols, glycol ethers, polyol ester, esters, and fatty acids and may comprise one or more of the following compounds: glycerin, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

A typical process to produce cast leaf includes the step of preparing the tobacco. For this, tobacco is shredded. The shredded tobacco is then blended with other kinds of tobacco and grinded. Typically, other kinds of tobacco are other types of tobacco such as Virginia or Burley, or may for example also be differently treated tobacco. The blending and grinding steps may be switched. The fibers are prepared separately and preferably such as to be used for the slurry in the form of a solution. Since fibers are mainly present in the slurry for providing stability to the cast leaf or generally to the aerosol-forming substrate, the amount of fibers may be reduced or fibers may even be omitted due to the aerosol-forming substrate being stabilized by the continuous sheet-like material.

If present, the fiber solution and the prepared tobacco are then mixed. The slurry is then transferred to a sheet forming apparatus. In the present method this is a surface, for example of a continuous belt or of the inductively heatable continuous sheet-like material, where the slurry may continuously be spread onto. The tobacco containing slurry is distributed on the surface to form a sheet. The sheet is then dried, preferably by heat and cooled after drying.

Preferably, the tobacco containing slurry comprises homogenized tobacco material and comprises glycerin as aerosol former. Preferably, the aerosol-forming substrate is made of a cast leaf as described above.

The inductively heatable continuous sheet-like material is a continuous sheet-like susceptor. A susceptor is a material that is capable of absorbing electromagnetic energy and converting it to heat. When located in an alternating electromagnetic field, typically eddy currents are induced and hysteresis losses occur in the susceptor causing heating of the susceptor. In the inductively heatable aerosol-forming substrate according to the invention, changing electromagnetic fields generated by one or several inductors, for example, induction coils of an inductive heating device heats the susceptor, which then transfers the heat to the aerosol-forming substrate, mainly by conduction of heat such that an aerosol is formed. Such a transfer of heat is best, if the susceptor is in close thermal contact with the tobacco material and aerosol former of the aerosol-forming substrate as in the present invention. Since the inductively heatable continuous sheet-like material and the tobacco containing slurry are joined in a wet state of the material of the aerosol-forming substrate a close interface between inductively heatable continuous material and aerosol-forming substrate may be formed. An inductively heatable sheet-like material may even at least partly or entirely be embedded in the aerosol-forming substrate.

The inductively heatable continuous sheet-like material may be porous or non-porous, that is, the sheet-like material may be provided with openings or may be substantially closed. The inductively heatable continuous sheet-like material may, for example, be in the form of a foil, mesh or web. Porous sheet-like materials may be woven or non-woven.

The susceptor may be formed from any material that can be inductively heated to a temperature sufficient to generate an aerosol from the aerosol-forming substrate and that allow the manufacture of a continuous sheet-like material such as a foil or mesh. Preferred susceptors comprise a metal or carbon. A preferred susceptor may comprise or consist of a ferromagnetic material, for example a ferromagnetic alloy, ferritic iron, or a ferromagnetic steel or stainless steel. A suitable susceptor may be, or comprise, aluminium. Preferred susceptors may be heated to a temperature in excess of 250 degrees Celsius.

Preferably, the inductively heatable continuous sheet-like material is a continuous metallic susceptor material.

The susceptor may also be a multi-material susceptor and may comprise a first susceptor material and a second susceptor material. The first susceptor material may be disposed in intimate physical contact with the second susceptor material. The second susceptor material preferably has a Curie temperature that is below the ignition point of the aerosol-forming substrate. The first susceptor material is preferably used primarily to heat the susceptor when the susceptor is placed in a fluctuating electromagnetic field. Any suitable material may be used. For example the first susceptor material may be aluminium, or may be a ferrous material such as a stainless steel. The second susceptor material is preferably used primarily to indicate when the susceptor has reached a specific temperature, that temperature being the Curie temperature of the second susceptor material. The Curie temperature of the second susceptor material can be used to regulate the temperature of the entire susceptor during operation. Suitable materials for the second susceptor material may include nickel and certain nickel alloys.

By providing a susceptor having at least a first and a second susceptor material, the heating of the aerosol-forming substrate and the temperature control of the heating may be separated. Preferably the second susceptor material is a magnetic material having a second Curie temperature that is substantially the same as a desired maximum heating temperature. That is, it is preferable that the second Curie temperature is approximately the same as the temperature that the susceptor should be heated to in order to generate an aerosol from the aerosol-forming substrate.

The inductively heatable aerosol-forming substrate may be used to form an inductively heatable aerosol-forming product. The inductively heatable aerosol-forming substrate may be formed into a rod-shape, for example by one or a combination of gathering, crimping, rolling or folding the inductively heatable aerosol-forming substrate. A substrate treating and rod-forming method may be applied, such as for example described in the international patent publication WO-A-2012/164009. The so formed rod may be cut into a required rod length of a tobacco product, for example individual inductively heatable aerosol-forming tobacco plugs. Preferably, these plugs are use in an inductively heatable aerosol-forming article, such as a smoking article for use in an inductively heatable device. The plugs may, for example, be used in an aerosol forming article as described in the international patent publication WO-A-2013/098405.

In a tobacco product manufactured from the inductively heatable aerosol-forming substrate according to the invention, the susceptor material is substantially and preferably homogeneously distributed over a length and cross section of the tobacco product. By this, a uniform heat loss in the aerosol-forming substrate may be achieved thus generating a uniform heat distribution in the aerosol-forming substrate and in the tobacco product leading to a uniform temperature distribution in the tobacco product.

Uniform or homogeneous temperature distribution in the tobacco product is herein understood as a tobacco product having a substantially similar temperature distribution over a cross section of the tobacco product. Preferably, the tobacco product may be heated such that temperatures in different regions of the tobacco product, such as for example central regions and peripheral regions of the tobacco product, differ by less than 50 percent, preferably by less than 30 percent.

Preferably, average temperatures of the tobacco product are 200 degree Celsius to 240 degrees Celsius. This has been found to be a temperature range where desired amounts of volatile compounds are produced, especially in tobacco sheet made of homogenized tobacco material with glycerin as aerosol former, especially in cast leaf as described above. At these temperatures no substantial overheating of individual regions of the tobacco product is achieved.

According to another aspect of the invention, there is also provided an inductively heatable aerosol-forming substrate. The inductively heatable aerosol-forming substrate comprises a layer of tobacco containing aerosol-forming substrate and an inductively heatable continuous sheet-like material. The inductively heatable continuous sheet-like material is arranged at a surface of the layer of tobacco containing aerosol-forming substrate. The inductively heatable aerosol-forming substrate has a thickness between 0.1 millimeter and 2 millimeter, preferably between 0.3 millimeter and 1.5 millimeter, for example, 0.8 millimeter.

The layer of tobacco containing aerosol-forming substrate may have deviations in thickness of up to about 30 percent due to manufacturing tolerances.

As a general rule, whenever a value is mentioned throughout this application, this is to be understood such that the value is explicitly disclosed. However, a value is also to be understood as not having to be exactly the particular value due to technical considerations. A value may, for example, include a range of values corresponding to the exact value plus or minus 20 percent.

Depending on the manufacturing process of the inductively heatable aerosol-forming substrate, the inductively heatable continuous sheet-like material may be arranged on the surface of the layer of tobacco containing aerosol-forming substrate or may partly or entirely be embedded in the surface of the layer of tobacco containing aerosol-forming substrate. For example, a highly porous inductively heatable material, for example a mesh or web with large interstices, facilitates an embedding of the inductively heatable material in the aerosol-forming substrate. For example, if a slurry is applied to a mesh or a mesh is laid onto slurry, the slurry may penetrate into the openings and interstices in the mesh.

The thickness of the inductively heatable aerosol-forming substrate is limited due to material properties and the manufacturing process. It is also limited due to the application of the substrate, the substrate being used to form a tobacco product, preferably a rod-shaped tobacco product having a diameter of between 5 mm and 12 mm, for example 7 mm or 8 mm.

Various parameters are dependent on a ratio of the inductively heatable continuous sheet-like material to the amount of tobacco containing aerosol-forming substrate or a total thickness of the final inductively heatable aerosol-forming substrate, respectively. Such parameters may, for example, be heat introduction into and heat distribution in the inductively heatable aerosol-forming substrate or in a tobacco product, amount of aerosol formed or handling of the inductively heatable aerosol-forming substrate.

The ratio of a thickness of the inductively heatable continuous sheet-like material to the thickness of the inductively heatable aerosol-forming substrate may be between 0.005 and 1, preferably between 0.01 and 0.3, more preferably between 0.01 and 0.09, for example 0.02.

A thickness of the inductively heatable continuous sheet-like material may be between 10 micrometer and 70 micrometer, preferably between 20 micrometer and 50 micrometer, more preferably between 20 micrometer and 30 micrometer.

A thickness of the inductively heatable aerosol-forming substrate corresponds to the thickness of the dried substrate. The thickness of a slurry applied to a surface may be different due to a thickness change during drying of the slurry.

The invention is further described with regard to embodiments, which are illustrated by means of the following drawings, wherein.

Figures 1, 2:
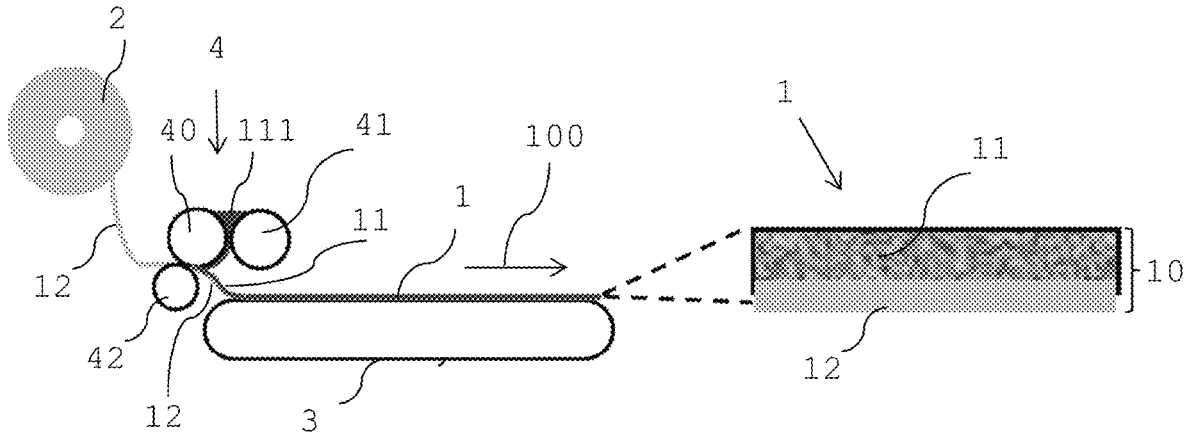
FIG. 1 is a schematic illustration of an embodiment of a manufacturing process for an inductively heatable aerosol-forming substrate.
FIG. 2 is an enlarged view of the inductively heatable aerosol-forming substrate, for example of FIG. 1.

As illustrated in FIG. 1, a sheet of susceptor material 12, for example a foil, is unwound from a bobbin 2 and supplied to a conveyor belt 3. The conveyor belt 3 is a closed-loop conveyor belt. The moving direction of the upper section of the conveyor belt 3 corresponding to the transport direction of the susceptor sheet 12 on the conveyor belt is indicated with arrow 100. Before the susceptor sheet 12 is supplied to the conveyor belt 3, a layer of aerosol-forming substrate 11 is applied onto the susceptor sheet 12 by a coater 4. In FIG. 1, the coater is embodied as reverse roller coater. A slurry of aerosol-forming substrate 111 is provided in a reservoir of the coater 4. The slurry 111 passes through a slit between an application roller 40 and a metering roller 41. A support roller 42 is arranged below the susceptor sheet 12 for supporting and aligning the sheet 12 below the coater 4. The sheet 12 with the slurry 111 applied thereon is then supplied to the conveyor belt 3. While being transported along the conveyor belt 3, the slurry 111 may be dried, preferably by the heated conveyor belt 3. After drying and possibly cooling, the so manufactured inductively heatable aerosol-forming substrate 1 may be used for the production of an inductively heatable aerosol-generating article. The inductively heatable aerosol-forming substrate 1 may, for example, be gathered and crimped and formed into a rod shape. The inductively heatable aerosol-forming substrate 1 with a layer of aerosol-forming substrate 11 on a layer of susceptor material 12 is shown in more detail in FIG. 2. The thickness 10 of the inductively heatable substrate is between 0.1 millimeter and 2 millimeter. Thickness variations of the layer of aerosol-forming substrate 11 may be much higher than of the layer of susceptor material 12 due to manufacturing tolerances of up to 30 percent of the layer of aerosol-forming substrate 11.

Figure 3:
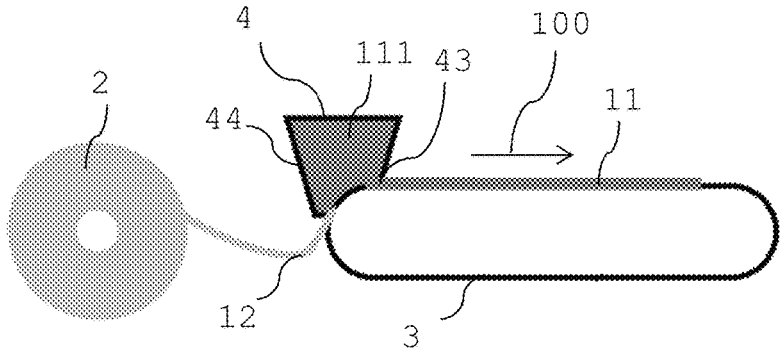
FIG. 3 is a schematic illustration of another embodiment of a manufacturing process.

In FIG. 3 the same reference numbers are used for the same or similar elements. FIG. 3 shows a manufacturing process, where the aerosol-forming slurry 111 is applied to a sheet-like susceptor material 12, at a time and position, where the susceptor material is already arranged and transported on the conveyor belt 3. A coater 4 is arranged at an upstream position of the conveyor belt 3. The coater 4 is embodied as a gate coater with a reservoir 44 holding slurry of aerosol-forming substrate 111. The bottom of the reservoir 44 has a slit 43 through which the slurry 111 may leave the coater 4. The slit is arranged most upstream of the transport section on the conveyor belt 3. Preferably, the transport section along which the inductively heatable substrate 1 is transported on the conveyor belt 3 is arranged horizontally or substantially horizontally (for example with a tilting angle less than plus or minus 10 degree). With a horizontal arrangement a flow of slurry into a direction other than the direction versus the susceptor 12 may be prevented.

In the embodiment shown in FIG. 3, the sheet-like susceptor material 12 may be a foil, but may also be a porous material, such as a web or mesh. Due to the susceptor material being arranged on the conveyor belt 3 no slurry 111 applied onto the susceptor may fall through interstices or openings of the susceptor 12. However, the slurry 111 may penetrate into the openings or interstices in the susceptor material. By this, a stronger interface may be achieved between substrate and susceptor material. The susceptor material may also be embedded in aerosol-forming substrate.

An embodiment, where the susceptor 12 is supported by the conveyor belt 3 when slurry 111 is applied, is also favourable for applications of very fragile sheet-like susceptor materials.

The embodiments shown in the figures are examples only and it is obvious that many variations are within the scope of the invention. For example, the arrangement of a layer of tobacco containing substrate and the susceptor material may be reversed. For example, an aerosol-forming slurry may be applied to the conveyor belt. During manufacturing, the susceptor material is then provided on top of the layer of slurry. Preferably, the susceptor material is a porous material when applied on top of slurry, such that moisture and other volatile substances may pass through the susceptor material upon drying of the slurry. The conveyor belt may be provided with openings to support removal of moisture from the slurry arranged on the conveyor belt. Preferably, such openings in the conveyor belt are small enough for slurry to not be able to pass through but large enough for moisture to pass through.

A joining of tobacco containing slurry and inductively heatable material may also be performed in a batch wise manner. The inductively heatable material may then be laid onto a support, while the slurry is applied to the inductively heatable material or vice versa. Before or after the slurry has dried, the inductively heatable aerosol-forming substrate is removed and a new layer of inductively heatable material or slurry may be provided on the support.

The invention claimed is:

1. A rod-shaped inductively heatable aerosol-forming article formed of a gathered or folded inductively heatable aerosol-forming substrate, the inductively heatable aerosol-forming substrate comprising a layer of tobacco containing aerosol-forming substrate and an inductively heatable continuous sheet-like material, wherein the inductively heatable continuous sheet-like material is arranged at a surface of the layer of tobacco containing aerosol-forming substrate, and wherein the inductively heatable aerosol-forming substrate has a thickness between 0.3 millimeter and 1.5 millimeter and wherein the inductively heatable continuous sheet-like material is homogenously distributed over the cross section of the rod.

2. The inductively heatable aerosol-forming article according to claim 1, wherein the inductively heatable continuous sheet-like material is arranged on the surface or is embedded in the surface of the layer of tobacco containing aerosol-forming substrate.

3. The inductively heatable aerosol-forming article according to claim 1, wherein a ratio of a thickness of the inductively heatable continuous sheet-like material to the thickness of the inductively heatable aerosol-forming substrate is between 0.005 and 0.3.

4. The inductively heatable aerosol-forming article according to claim 1, wherein a thickness of the inductively heatable continuous sheet-like material is between 10 micrometer and 70 micrometer.

5. The inductively heatable aerosol-forming article according to claim 4, wherein the inductively heatable continuous sheet-like material has a thickness in between 20 micrometers and 30 micrometers.

6. The inductively heatable aerosol-forming article according to claim 1, wherein the inductively heatable continuous sheet-like material has the form of a foil, mesh or web.

7. The inductively heatable aerosol-forming article according to claim 1, wherein the inductively heatable continuous sheet-like material is a continuous metallic susceptor material.

8. The inductively heatable aerosol-forming article according to claim 1, wherein the inductively heatable continuous sheet-like material is a non-porous or closed sheet.

9. The inductively heatable aerosol-forming article according to claim 1, wherein the inductively heatable continuous sheet-like material comprises a ferromagnetic material.

10. The inductively heatable aerosol-forming article according to claim 1, wherein the inductively heatable continuous sheet-like material is a multi-material susceptor sheet.

11. The inductively heatable aerosol-forming article according to claim 10, wherein the multi-material susceptor sheet comprises a first susceptor material primarily for heating the inductively heatable aerosol-forming substrate and a second susceptor material primarily used as temperature indicator.

12. The inductively heatable aerosol-forming article according to claim 11, wherein the second susceptor material is a magnetic material.

13. The inductively heatable aerosol-forming article according to claim 1, wherein the layer of tobacco containing aerosol-forming substrate comprises homogenized tobacco material.

14. The inductively heatable aerosol-forming article according to claim 1, wherein the layer of tobacco containing aerosol-forming substrate comprises an aerosol-former.

* * * * *